US005090698A

United States Patent [19]

Kleinfelter

[11] Patent Number: 5,090,698

[45] Date of Patent: Feb. 25, 1992

[54] GOLF PUTTER

[76] Inventor: Thomas A. Kleinfelter, 891 Hlavka Rd., Maple City, Mich. 49664

[21] Appl. No.: 499,662

[22] Filed: Mar. 27, 1990

[51] Int. Cl.[5] ..... A63B 53/04; A63B 53/02

[52] U.S. Cl. ..... 273/80.2; 273/167 C; 273/173

[58] Field of Search ..... 273/167–175, 273/164, 77 A, 77 R, 80 R, 80 A, 80.2, 67 C, 67 D, 83, 80 C; D21/210, 211, 214–220

[56] References Cited

U.S. PATENT DOCUMENTS

| | | | |
|---|---|---|---|
| D. 246,865 | 1/1978 | Krysakowski | 273/167 X |
| D. 255,477 | 6/1980 | Gida | D21/218 |
| 3,226,120 | 12/1965 | Borah | 273/83 |
| 3,399,898 | 9/1968 | Burkland | 273/164 |
| 3,430,963 | 3/1969 | Wozniak et al. | 273/164 |
| 3,637,218 | 1/1972 | Carlino | 273/168 |
| 3,908,996 | 9/1975 | Molinaro | 273/83 |
| 3,909,005 | 9/1975 | Piszel | 273/171 |
| 4,017,083 | 4/1977 | Johnson | 273/164 |
| 4,063,733 | 12/1977 | Benedict | 273/80 C |
| 4,174,110 | 11/1979 | Yamamoto | 273/169 |
| 4,324,404 | 4/1982 | Dian | 273/169 |
| 4,444,395 | 4/1984 | Reiss | 273/171 |
| 4,508,342 | 4/1985 | Drake | 273/80 C |
| 4,927,144 | 5/1990 | Stormon | 273/80 A |

*Primary Examiner*—Edward M. Coven
*Assistant Examiner*—Sebastiano Passaniti
*Attorney, Agent, or Firm*—Terry M. Gernstein

[57] ABSTRACT

A golf putter is shaped and has the shaft thereof connected to the clubhead thereof so that the club has a center of percussion that extends for essentially the entire length of the clubhead. The shaft is attached to the clubhead internally of that clubhead.

19 Claims, 3 Drawing Sheets

GOLF PUTTER

TECHNICAL FIELD OF THE INVENTION

The present invention relates to the general art of amusement devices, and to the particular field of golf equipment.

BACKGROUND OF THE INVENTION

As every serious golfer understands, putting is at least half of the game of golf. Simple arithmetic bears this conclusion out in that since two putts are allowed for each hole, a par seventy-two course allows half the strokes for putting. Birdies are generally made by using only one of the allotted two putts on a hole.

Among top players, shadings in shot-making ability are faint, and it is the putting game which often determines who wins a given tournament. For this reason, accomplished golfers spend a great deal of time working on their putting game.

Most secrets of good putting includes admonitions to move the clubhead low along the ground, to keep the putter square to the line of flight at impact, and to strike the ball on the clubhead's sweet spot. Most golfers practice these rules during a putting practice session.

Many golfer's use different stances for different putts. For example, a golfer on any given round may employ a square-to-square stroke, an inside-to-outside stroke, and an outside-to-inside stroke. Still further, many golfers use different style putters, ranging from a blade putter to a barrel-shaped putter. However, during any of these strokes or using any of the different putters, the ball should be struck on the club's sweet spot.

Since putting is such an important part of the game of golf, the art contains many examples of putters. While the art contains several different style putters, all of the presently available putters have a common drawback in that it is somewhat difficult to ensure that the golfer will strike the ball with the sweet spot each time he putts a ball. This is especially true if the golfer changes stances and strokes during a round. Even if the sweet spot is marked, it may still be difficult for a golfer to impact a ball with this marked spot.

The sweet spot of a golf club head is the center of percussion of that clubhead. The center of percussion is defined in terms of a rigid body, and is defined as the point of application of the resultant of all the forces tending to cause the body to rotate about a certain axis. The center of percussion is the point at which a suspended body may be struck without causing any pressure on the axis passing through the point of suspension. Thus, if a rigid body, free to move about a point O, and the line of force is perpendicular to the line from O to the center of mass, then the initial motion of the body is a rotation about the center of percussion relative to O. If a ball is struck at the center of percussion, no "sting" is felt if the club is held on the center of oscillation. If the ball is struck off of the center of percussion, there may be a twisting force exerted on the club.

As above mentioned, one of the basic tenants of good putting technique is to keep the clubhead square to the line of flight at impact. Thus, since striking the ball with a club at a location spaced from the sweet spot may tend to twist the club, it is important for the putter to permit the golfer to strike the sweet spot against the ball, no matter what the stroke, the stance or the type of putter is being used.

While many of the presently-available putters have a marked sweet spot, in fact, the sweet spot is so small that it is difficult to hit. Even further to this, striking a ball off of the sweet spot may cause the club to twist in different ways depending on how and where the ball is struck relative to the sweet spot. This rotation of the club may cause a putt to be errant for no apparent reason so that a golfer cannot even truly analyze the stroke to correct it.

Thus, it is extremely important for any golf club to permit the ball to be impacted at the clubhead's sweet spot. However, due to the precise nature and the importance of the putting portion of the game, it is even more critical that the putter have a sweet spot that is easy to hit in a consistent manner, no matter what stance and swing is used. It is in this area that prior art putters fall short.

Still further, the club shaft of these putters is attached to the clubhead in a manner which may even unbalance the putter, especially if the ball is struck off of the sweet spot. Often, this connection of the head to the shaft is such as to actually interfere with the putting stroke, especially if the putt must be made from near the fringe of a green where the grass may be of different lengths. Still further, the connection between the clubhead and the shaft of many prior art putters can loosen over time thereby further vitiating even a proper stroke.

Therefore, there is a need for a putter which permits a golfer to consistently strike the ball on the sweet spot of the clubhead, and which has the clubhead connected to the club shaft in a manner which is secure and is not likely to disturb or vitiate the golfer's putting stroke.

OBJECTS OF THE INVENTION

It is a main object of the present invention to provide a putter which permits a golfer to consistently strike the ball on the sweet spot of the clubhead.

It is another object of the present invention to provide a putter which permits a golfer to consistently strike the ball on the sweet spot of the clubhead, and which has the clubhead connected to the club shaft in a manner which is secure and is not likely to disturb or vitiate the golfer's putting stroke.

SUMMARY OF THE INVENTION

These, and other, objects are achieved by a putter, specifically a putter having a barrel-shaped clubhead, which has the center of percussion enlarged so as to make it quite easy for a golfer to consistently impact a ball with the clubhead's sweet spot no matter what type of stroke or stance is being used and no matter what the conditions of the putt. The putter is also designed so that the connection of the clubhead to the shaft does not interfere with this consistent impact at the sweet spot and will, in fact, will make it easier to strike the ball at the proper location on the club.

Specifically, the distance from the axis of suspension of an element to the center of percussion is generally given by the relationship $q_0=I/(mx_0)$, where I=the moment of inertia of the body about its axis of suspension to the center of gravity of the body; m=the mass of the body; $x_0$=a characteristic dimension of the body; and $q_0$=the distance from the axis suspension to the center of percussion. The design of the putter embodying the present invention sets the value of I/m so the center of percussion for the club is quite large without making the club cumbersome to handle. In fact, the specific design of the present achieves the object of enlarging the center of percussion, it does so in a manner which synergistically also achieves the additional objects of affecting the attachment of the shaft to the clubhead without having the attachment located where it might interfere with the putting stroke, and can be located in the most advantageous position on the clubhead.

Still further, the attachment of the shaft to the clubhead is at two widely spaced apart locations so that shaft energy is transferred to the clubhead over a wide spacing. The swing energy is thus distributed over a large surface area of the clubhead. Such enlargement of attachment area further decreases the possibility that the clubhead will twist at impact since impact force is almost always at the point of attachment of the clubhead to the shaft. This feature of the invention can be visualized by comparing the effects of an impact on a cantilever beam versus the effect of the same impact at the same location on a simple beam. Referring to FIG. 1A, it is seen that impact point IP is spaced from support point S on the cantilever beam CB will cause a twisting moment TM about the support point S, with a mirror image effect occurring for a support point located at the opposite end of the beam. The magnitude of the twisting moment TM varies as a function of the moment arm MA as measured between points IP and S.

However, as shown in FIG. 1B, a simple beam SB is supported at two points $S_1$ and $S_2$ so impact at point IP will not cause a twisting of the beam no matter where the beam is struck. Even if the cantilever beam is weighted at its ends, the twisting will occur; whereas, even if the simple beam is unweighted, the twisting will not occur.

In effect, one way of viewing this feature could be that the center of percussion covers essentially the entire length of the beam since no twisting will occur no matter where the beam is struck.

Still further, by connecting the shaft to the clubhead at spaced apart locations, any pressure waves set up in the clubhead as a result of the impact between the clubhead and the ball will be damped and controlled in a manner that is specifically set up at the factory. Thus, uncontrolled vibrations are not likely to occur in the putter embodying the present invention thereby making this putter easier to control and handle as compared to prior putters.

Still further, the clubhead of the present invention is attached to the shaft internally of the clubhead. Thus, movement of the clubhead is not likely to be affected by contact of attaching elements with the grass or the ground beneath the putter. This internal attachment will also not be affected by environmental conditions, so it will remain secure and consistent throughout the lifetime of the club.

BRIEF DESCRIPTION OF THE DRAWING FIGURES

DETAILED DESCRIPTION OF THE PREFERRED EMBODIMENT OF THE INVENTION

Figure 1A:
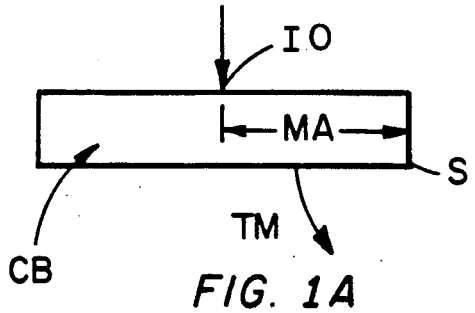
FIG. 1A is a schematic illustrating a cantilever beam.
Figure 1B:
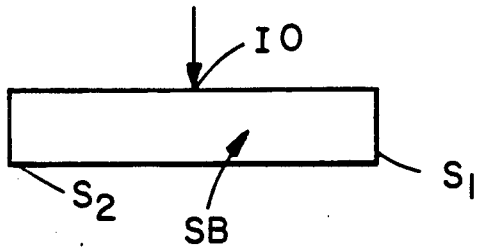
FIG. 1B is a schematic illustrating a simple beam.
Figure 2:
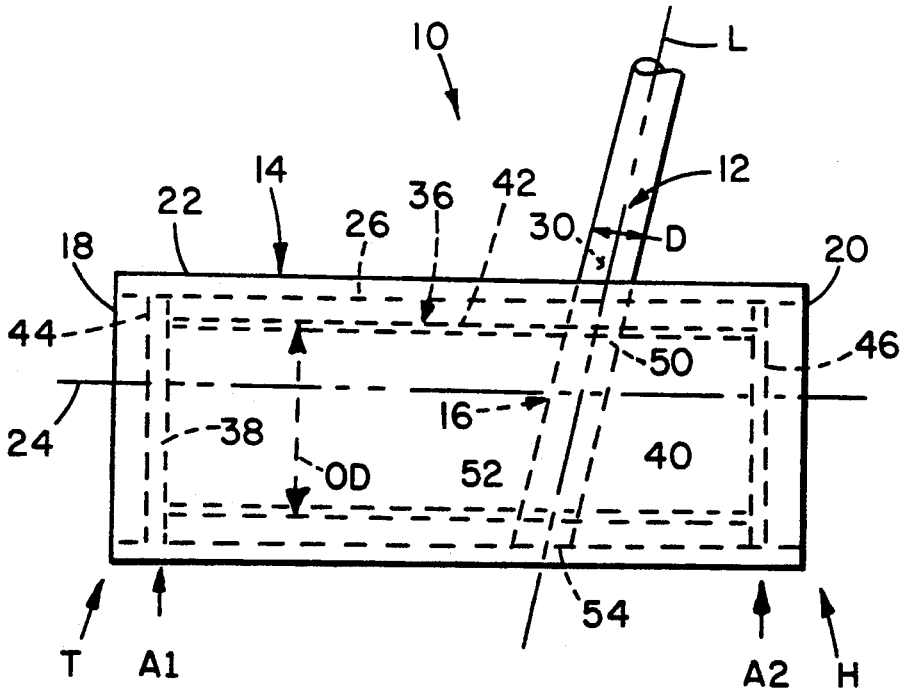
FIG. 2 is an elevational view of a barrel-shaped putter embodying the present invention.
Figure 6:
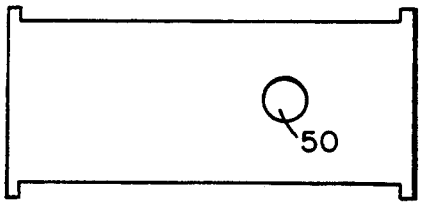
FIG. 6 is a top plan view of an insert element of the putter.
Figure 3:
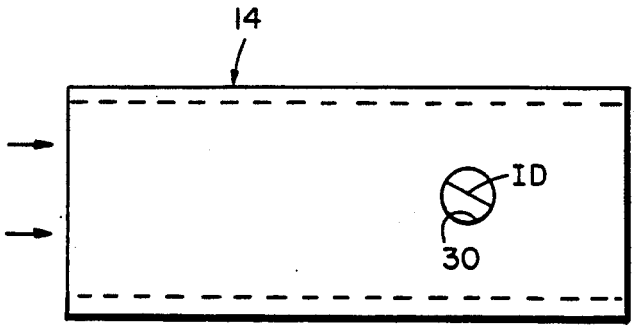
FIG. 3 is a top plan view of a sleeve element of the putter.
Figure 7:
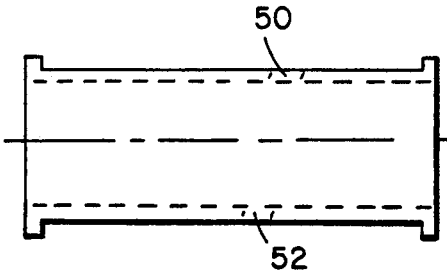
FIG. 7 is a side elevational view of the insert element.
Figure 4:
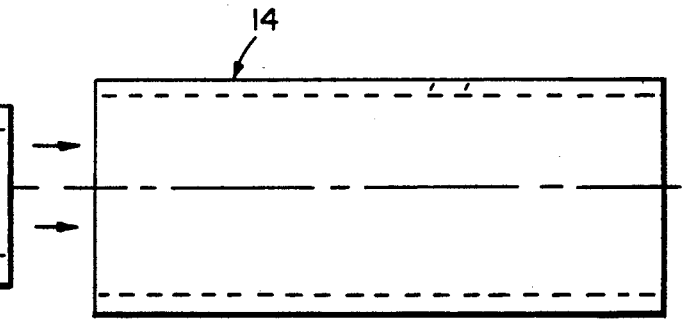
FIG. 4 is a side elevational view of the sleeve element.
Figure 8:
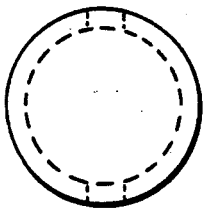
FIG. 8 is an end elevational view of the insert element.
Figure 5:
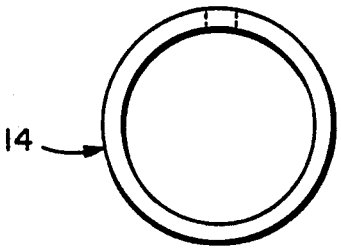
FIG. 5 is an end elevational view of the sleeve element.

Shown in FIG. 2 is a putter 10 embodying the present invention. The putter 10 includes a shaft 12 which is gripped at a top end (not shown) by a golfer during a putting stroke, and a barrel-shaped clubhead 14 attached to that shaft near a bottom end 16 thereof.

The clubhead 12 is shown as being barrel-shaped; however, other putter clubhead shapes, such as blade and the like, can also be used without departing from the scope of the present invention. The barrel-shaped clubhead is shown as a preferred embodiment only, and no limitation is to be interpreted thereby.

The shaft 12 has an outer dimension D, which is generally the outer diameter of a cylindrical shaft, and a longitudinal axis L. The shaft 12 is attached to the clubhead at two spaced apart locations A1 and A2, and the clubhead is designed so that the center of percussion, or sweet spot, extends for essentially the entire area between locations A1 and A2, that is, essentially the entire length of the clubhead as measured between clubhead toe T and heel H. The shaft is thus connected to the clubhead in the manner of a simple beam, with locations A1 and A2 corresponding to the simple beam supports $S_1$ and $S_2$ respectively. The design of the clubhead and the attaching elements are also such that the value I/m in the center of percussion relationship is such as to further ensure that the center of percussion will be located between locations A1 and A2.

More specifically, the clubhead 14 includes a sleeve element best shown in FIGS. 1 and 3–5. The sleeve element 14 forms the striking surface of the clubhead and includes a first end 18 and a second end 20 corresponding to the putter toe and heel ends respectively. A wall 22, which in the case of a barrel-shaped clubhead is cylindrical, connects the first and second ends together, and has a longitudinal axis 24 extending from the first end 18 to the second end 20.

The sleeve element 14 also includes a central bore 26 extending from the first to the second end thereof, with that bore 26 having an inner dimension as measured thereacross on the inner surface of the sleeve element adjacent to the bore. In the case of a cylindrical sleeve element, this inner dimension is the inner diameter of the element.

The sleeve element has a golf club shaft-receiving hole 30 defined therethrough from the outer surface of the sleeve and intersecting the bore 26. The hole 30 extends at a skewed angle with respect to the longitudinal centerlines L and 24. The hole has an inner dimension ID, such as the inner diameter, which is greater than the outer dimension D of the shaft so that shaft 12 fits through the hole 30 in a loose fit. This loose fit is such that the shaft 12 can move freely into and out of the bore via the hole 30 without significant interference. The purpose of this loose fit is so that the shaft 12 will not be connected to the sleeve element via the sleeve wall 22. The angle of the hole is such that the angle of the shaft 12 with respect to the axis 24 is 68°, 70°, 72° or 80° so the clubhead can be at standard angles with respect to the shaft. The preferred material for the sleeve element is metal, specifically brass. However, other materials can be used without departing from the scope of the present disclosure.

Referring next to FIGS. 2, 6, 7 and 8, it is seen that the clubhead further comprises an insert element 36 located in the sleeve element and connecting the shaft 12 to the sleeve element. The insert element includes a first end 38 and a second end 40 connected together by a body 42. The body 42 has an outer dimension OD, which in the case of a cylindrical shape corresponds to the outer diameter thereof, which is smaller than the inner dimension of the sleeve element so that the body 42 is spaced from the sleeve.

The insert element also includes a first flange element 44 on the first end 38 and a second flange element 46 on the second end 40. The flange elements 44 and 46 can be monolithic with the body 42, but are described separately for the sake of convenience.

Each of the flange elements has an outer dimension, in the case of a circular flange, the outer diameter, that matches the inner dimension of the sleeve element. The outer dimension of the flange elements is selected so that the flanges effect a force fit with the sleeve element inner surface so that once set inside the sleeve, the insert element will not move with respect to that sleeve element. The force fit can be effected by shrinking the sleeve onto the insert element using any of a number of well known shrink fit forming methods, such as freezing or the like. Adhesive can also be used to effect the attachment of the insert element to the sleeve element.

The insert element also includes two shaft-receiving holes 50 and 52, each having an inner dimension, specifically an inner diameter, that matches the shaft outer dimension D so that a force fit between the shaft and the insert element is effected adjacent to the holes 50 and 52. This force fit attaches the shaft to the insert element. As discussed above, the flanges 44 and 46 are attached to the sleeve element, and the shaft is essentially unattached to the sleeve element adjacent to the hole 30. Thus, the shaft is attached to the sleeve element via the insert element.

The holes 50 and 52 are also oriented at a skewed angle with respect to the centerlines 24 and L so that the angles of the holes 50 and 52 match the angle of the hole 30 whereby an alignment of hole centers is effected when the insert element is in place in the sleeve. Such alignment is indicated in FIG. 2. The shaft 12 extends through such aligned holes so that the shaft lowermost end 54 abuts the inner surface of the sleeve adjacent to the hole 52. As above noted, the insert element can be monolithic, and in such a case, the holes 50 and 52 represent the ends of a continuous hole extending transversely at an angle through the monolithic body.

The flanges 44 and 46 are located at positions A1 and A2, and thus the attachment of the shaft to the sleeve is at positions A1 and A2 which are widely spaced apart with the shaft being located between such positions. The combination of shapes, masses and connection locations effectively locate the club sweet spot at essentially the entire area between locations A1 and A2 so that a putt struck with the club 10 will be true and essentially always struck at the sweet spot of the club.

Figure 9:
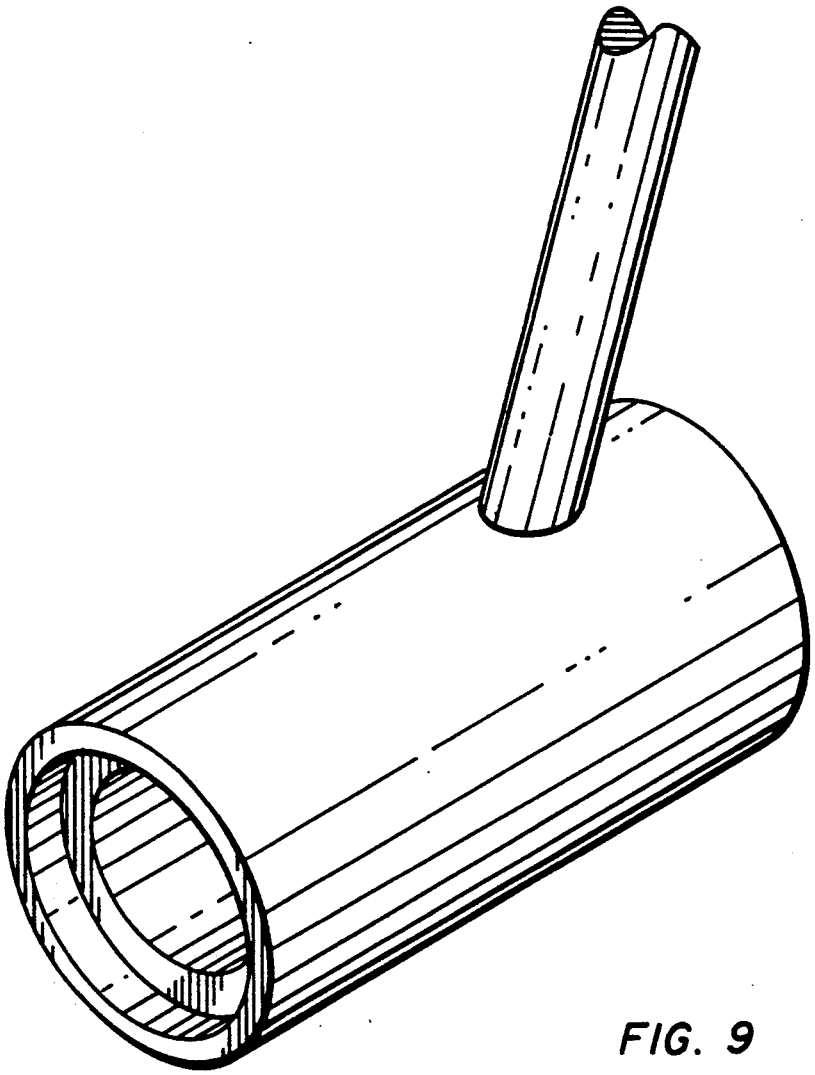
FIG. 9 is a perspective view showing the assembled device.

FIG. 9 is a perspective view showing the assembled device.

It is understood that while certain forms of the present invention have been illustrated and described herein, it is not to be limited to the specific forms or arrangements of parts described and shown.

I claim:

1. A golf putter comprising:

A) a shaft having an outer dimension;

B) a sleeve having (1) a first end, (2) a second end, (3) a wall connecting said first and second ends together, (4) a longitudinal axis extending between said first and second ends, (5) a bore extending along said longitudinal axis, (6) an inner surface adjacent to said bore and having an inner dimension, and (7) a shaft-receiving hole defined through said wall and intersecting said bore, said shaft-receiving hole having an inner dimension which is larger than said shaft outer dimension;

C) an insert element located in said sleeve bore and which includes (1) a first end, (2) a second end, (3) a wall connecting said insert element first end to said insert element second end, said insert element wall having an outer dimension which is smaller than the sleeve element inner dimension, (4) a first flange element on said insert element first end, (5) a second flange element on said insert element second end, (6) said first and second flange elements having outer dimensions which are essentially equal to the inner dimension of said sleeve element adjacent to said sleeve element bore and being attached to said sleeve element bore, (7) a club shaft-receiving hole defined in said insert element wall to be aligned with said sleeve element shaft-receiving hole when said insert element is in place in said sleeve element bore, said insert element shaft-receiving hole having a dimension which is essentially equal to the club shaft outer dimension to attach said insert element to said shaft.

2. The golf putter defined in claim 1 wherein said insert element is monolithic.

3. The golf putter defined in claim 1 wherein said sleeve element is metal.

4. The golf putter defined in claim 3 wherein said metal includes brass.

5. The golf putter defined in claim 4 wherein said sleeve element is monolithic.

6. The golf putter defined in claim 1 wherein said insert element has an axial extent between said insert element first and second ends which is less than the axial extent of said sleeve element as measured between said sleeve element first and second ends.

7. The golf putter defined in claim 6 wherein said sleeve shaft-receiving hole is located between said insert element first and second ends when said insert element is in place in said sleeve element.

8. The golf putter defined in claim 7 wherein said insert element is hollow and has a second insert element shaft-receiving hole defined therein.

9. The golf putter defined in claim 8 wherein said sleeve element is cylindrical.

10. The golf putter defined in claim 8 wherein said sleeve and insert element shaft-receiving holes all extend at a skewed angle with respect to said sleeve element longitudinal axis.

11. The golf putter defined in claim 10 wherein said skewed angle is sixty-eight degrees.

12. The golf putter defined in claim 10 wherein said skewed angle is seventy degrees.

13. The golf putter defined in claim 10 wherein said skewed angle is seventy-two degrees.

14. The golf putter defined in claim 10 wherein said skewed angle is eighty degrees.

15. The golf putter defined in claim 10 wherein said insert element flange elements are attached to said sleeve element by a shrink fit.

16. The golf putter defined in claim 9 wherein said insert element wall is cylindrical, and said insert element flange elements are circular.

17. The golf putter defined in claim 16 wherein said insert element flange elements are attached to said sleeve element by adhesive.

18. The golf putter defined in claim 16 wherein one end of said golf club shaft abuts said sleeve element inner surface.

19. A golf putter comprising:

A) a golf club shaft having an outer dimension;

B) a clubhead attached to said golf club shaft and including (1) an insert element having spaced apart first and second ends and first and second spaced apart mounting elements on said first and second ends respectively, said insert element having an outer dimension and being connected to said golf club shaft, and (2) a sleeve element having spaced apart first and second ends, a shaft bore defined therethrough and located between said sleeve element first and second ends, said sleeve element shaft bore being larger than said golf club shaft outer dimension, and an insert element accommodating bore which has an inner dimension larger than said shaft outer dimension, and (3) said insert element mounting elements being fixed to said sleeve element.

* * * * *